US009404335B2

(12) United States Patent
Hallundbæk et al.

(10) Patent No.: US 9,404,335 B2
(45) Date of Patent: Aug. 2, 2016

(54) ANNULAR BARRIER SYSTEM WITH FLOW LINES

(71) Applicant: WELLTEC A/S, Allerød (DK)

(72) Inventors: Jørgen Hallundbæk, Græsted (DK); Paul Hazel, Aberdeen (GB)

(73) Assignee: WELLTEC A/S, Allerød (DK)

( * ) Notice: Subject to any disclaimer, the term of this patent is extended or adjusted under 35 U.S.C. 154(b) by 134 days.

(21) Appl. No.: 14/357,828

(22) PCT Filed: Nov. 29, 2012

(86) PCT No.: PCT/EP2012/073918

§ 371 (c)(1),
(2) Date: May 13, 2014

(87) PCT Pub. No.: WO2013/079575

PCT Pub. Date: Jun. 6, 2013

(65) Prior Publication Data

US 2014/0311759 A1 Oct. 23, 2014

(30) Foreign Application Priority Data

Nov. 30, 2011 (EP) ..... 11191287

(51) Int. Cl.
*E21B 33/127* (2006.01)
*E21B 33/124* (2006.01)

(52) U.S. Cl.
CPC ..... *E21B 33/127* (2013.01); *E21B 33/1243* (2013.01); *E21B 33/1277* (2013.01)

(58) Field of Classification Search
CPC ..... E21B 33/1243; E21B 33/1277
See application file for complete search history.

(56) References Cited

U.S. PATENT DOCUMENTS 2,851,111 A * 9/1958 Jones ..... E21B 33/1243 166/122
3,269,462 A * 8/1966 Voetter ..... E21B 49/10 166/100

(Continued)

FOREIGN PATENT DOCUMENTS

EP 1 455 052 9/2004
WO WO 2010/136806 12/2010

OTHER PUBLICATIONS

International Search Report for PCT/ EP2012/073918 mailed Feb. 5, 2013.

(Continued)

*Primary Examiner* — Shane Bomar
(74) *Attorney, Agent, or Firm* — Nixon & Vanderhye P.C.

(57) ABSTRACT

The present invention relates to an annular barrier system (100) connected with a well head (40) via a well tubular structure (3), comprising a first annular barrier (1) and a second annular barrier (21) to be expanded in an annulus (2) between the well tubular structure and an inside wall (4) of a casing (20) or a borehole (5) downhole for providing zone isolation between a first zone (8) and a second zone (9), each annular barrier comprising a tubular part (6) extending in a longitudinal direction for mounting as part of the well tubular structure, an expandable sleeve (7) surrounding the tubular part and defining a space (13), an opening (11) for letting fluid into the space to expand the sleeve, and a first connection part (15) and a second connection part (16) connecting the expandable sleeve with the tubular part, and wherein the first connection part is arranged nearest to the well head, the system further comprising a flow line (17) fluidly connecting the well head with the opening for supplying fluid to the opening for expanding the expandable sleeve. Furthermore, the present invention relates to a well completion system and method.

19 Claims, 6 Drawing Sheets

(56) References Cited

U.S. PATENT DOCUMENTS

| | | | | | |
|---|---|---|---|---|---|
| 4,043,192 | A * | 8/1977 | Shuck | E21B 33/1243 | 73/152.41 |
| 4,230,180 | A * | 10/1980 | Patton | E21B 33/124 | 166/100 |
| 4,353,249 | A | 10/1982 | Lagus et al. | | |
| 4,573,532 | A * | 3/1986 | Blake | E21B 33/1243 | 137/625.19 |
| 5,195,583 | A * | 3/1993 | Toon | E21B 33/1243 | 166/179 |
| 5,505,258 | A * | 4/1996 | Muth | E21B 33/122 | 166/177 |
| 5,522,463 | A * | 6/1996 | Barbee | E21B 43/121 | 166/106 |
| 6,286,603 | B1 * | 9/2001 | Parent | E21B 33/1208 | 166/187 |
| 6,581,455 | B1 * | 6/2003 | Berger | E21B 21/103 | 175/50 |
| 6,698,976 | B1 * | 3/2004 | Cho | E03B 3/20 | 166/187 |
| 7,216,706 | B2 * | 5/2007 | Echols | E21B 33/12 | 166/177.1 |
| 2004/0055758 | A1 | 3/2004 | Brezinski et al. | | |
| 2004/0173363 | A1 | 9/2004 | Navarro-Sorroche | | |
| 2011/0266004 | A1 * | 11/2011 | Hallundbaek | E21B 33/1208 | 166/369 |
| 2012/0125619 | A1 | 5/2012 | Wood et al. | | |
| 2016/0024894 | A1 * | 1/2016 | Campbell | E21B 33/1243 | 166/278 |

OTHER PUBLICATIONS

Written Opinion of the International Searching Authority for PCT/EP2012/073918 mailed Feb. 5, 2013.

International Preliminary Report on Patentability issued in International Application No. PCT/EP2012/073918 dated Jun. 3, 2014.

* cited by examiner

ANNULAR BARRIER SYSTEM WITH FLOW LINES

This application is the U.S. national phase of International Application No. PCT/EP2012/073918 filed 29 Nov. 2012 which designated the U.S. and claims priority to EP 11191287.9 filed 30 Nov. 2011, the entire contents of each of which are hereby incorporated by reference.

FIELD OF THE INVENTION

The present invention relates to an annular barrier system connected with a well head via a well tubular structure, comprising a first annular barrier and a second annular barrier to be expanded in an annulus between the well tubular structure and an inside wall of a casing or a borehole downhole for providing zone isolation between a first zone and a second zone. Furthermore, the present invention relates to a well completion system and method.

BACKGROUND ART

In known annular barrier solutions, the well casing is pressurised in order to expand the annular barriers, but not all components of a completion can withstand such high pressure, and therefore an alternative solution is needed in order to protect these components while expanding the annular barriers.

SUMMARY OF THE INVENTION

It is an object of the present invention to wholly or partly overcome the above disadvantages and drawbacks of the prior art. More specifically, it is an object to provide an improved annular barrier system, wherein the expansion of the expandable sleeve of the annular barrier provides a solution which is safer than known solutions in order to avoid pressurising the casing from within to expand the annular barriers.

The above objects, together with numerous other objects, advantages, and features, which will become evident from the below description, are accomplished by a solution in accordance with the present invention by an annular barrier system connected with a well head via a well tubular structure, comprising:

- an annular barrier to be expanded in an annulus between the well tubular structure and an inside wall of a casing or a borehole downhole for providing zone isolation between a first zone and a second zone, the annular barrier comprising:
- a tubular part extending in a longitudinal direction for mounting as part of the well tubular structure;
- an expandable sleeve surrounding the tubular part and defining a space;
- an opening for letting fluid into the space to expand the sleeve; and
- a first connection part and a second connection part connecting the expandable sleeve with the tubular part, and wherein the first connection part is arranged nearest to the well head, wherein the system further comprises a flow line fluidly connecting the well head with the opening for supplying fluid to the opening for expanding the expandable sleeve.

In another embodiment, the annular barrier system may be connected with a well head via a well tubular structure, and comprises:

- a first annular barrier and a second annular barrier to be expanded in an annulus between the well tubular structure and an inside wall of a casing or a borehole downhole for providing zone isolation between a first zone and a second zone, each annular barrier comprising:
- a tubular part extending in a longitudinal direction for mounting as part of the well tubular structure;
- an expandable sleeve surrounding the tubular part and defining a space;
- an opening for letting fluid into the space to expand the sleeve; and
- a first connection part and a second connection part connecting the expandable sleeve with the tubular part, and wherein the first connection part is arranged nearest to the well head, the system further comprising a flow line fluidly connecting the well head with the opening for supplying fluid to the opening for expanding the expandable sleeve, and the second connection part of the first annular barrier having a second opening and the second opening of the second connection part being fluidly connected with an opening arranged in the first connection part of the second annular barrier via a second flow line part for expanding the expandable sleeve of the second annular barrier, wherein a second valve is arranged in the second opening, the second valve being a two-way valve which, at a predetermined pressure, disconnects communication to the second annular barrier and opens fluid communication to an annular space between the annular barriers in their expanded condition to pressurise the annular space.

In one embodiment, a valve may be arranged in the opening.

Also, the valve may be adapted to close at a predetermined pressure.

In another embodiment, the flow line may extend along an outer face of the well tubular structure.

Moreover, the flow line may extend inside or in a groove in the well tubular structure.

In yet another embodiment, the opening may be arranged in the connection part or in the tubular part.

Furthermore, the flow line may have an overall outer diameter which is substantially smaller than an overall outer diameter of the tubular part.

The outer diameter of the flow line may be less than 50% of the outer diameter of the tubular part, preferably less than 30% of the outer diameter of the tubular part, more preferably less than 15% or less of the outer diameter of the tubular part.

In one embodiment, the well head may comprise a well head valve.

Said well head valve may be connected to a pumping unit.

In another embodiment, the first connection part may have the opening fluidly connected to the well head via the flow line.

The annular barrier system as described above may further comprise a second annular barrier comprising a tubular part extending in a longitudinal direction for mounting as part of the well tubular structure, an expandable sleeve surrounding the tubular part and defining a space, an opening for letting fluid into the space to expand the sleeve, and a first connection part and a second connection part connecting the expandable sleeve with the tubular part, and the first connection part may be arranged nearest to the well head.

Moreover, the second connection part may have a second opening and the second opening of the second connection part may be fluidly connected with an opening arranged in the first connection part of the second annular barrier via a second flow line part for expanding the expandable sleeve of the second annular barrier.

In one embodiment, a second valve may be arranged in the second opening.

Also, the second valve may be adapted to close at a predetermined pressure.

Furthermore, the annular barrier system may comprise a second flow line in order to let fluid into an annular space between the annular barriers in their expanded condition to pressurise the annular space, and the system may comprise a switch valve fluidly connecting the first flow line with the second flow line when the fluid reaches a predetermined pressure.

Moreover, the second flow line may be connected with a fluid channel in the first annular barrier, and the channel extends through the first annular barrier in order to let fluid into the annular space.

In one embodiment, the switch valve may be a hydrostatic switch.

Further, the second valve may be a two-way valve which, at a predetermined pressure, may disconnect communication to the second annular barrier and may open fluid communication to an annular space between the annular barriers in their expanded condition to pressurise the annular space.

In another embodiment, the system may comprise a release device arranged in connection with the opening for disconnecting the flow line after expansion of the sleeve.

In yet another embodiment, a cutting device may be arranged in connection with the well head.

Furthermore, the system may comprise a pressure sensor tool.

Moreover, the tool may comprise a gas detection unit and/or a pressure measuring unit.

Also, the annular barrier system as described above may comprise a third annular barrier comprising:

- a tubular part extending in a longitudinal direction for mounting as part of the well tubular structure;
- an expandable sleeve surrounding the tubular part and defining a space;
- an opening for letting fluid into the space to expand the sleeve; and
- a first connection part and a second connection part connecting the expandable sleeve with the tubular part, and wherein the first connection part is arranged nearest to the well head, the system further comprising a flow line fluidly connecting the opening in the second connection part of the second annular barrier with an opening in the first connection part of the third annular barrier for supplying fluid to the opening for expanding the expandable sleeve of the third annular barrier, The annular barrier system as described above may further comprise a second flow line for letting fluid into an annular space between the first and second annular barriers in expanded condition to pressurise the annular space.

In addition, the annular barrier system as described above may further comprise a switch valve fluidly connecting the first flow line with the second flow line when the fluid reaches a predetermined pressure.

In one embodiment, the second flow line may be connected with a fluid channel in the first annular barrier, and the channel may extend through the first annular barrier in order to let fluid into the annular space.

Furthermore, the switch valve may be a hydrostatic switch.

In one embodiment, the opening may be arranged in the tubular part and the flow line may extend in the tubular part.

In another embodiment, the second valve of the second connection part may be fluidly connected with an opening in a first connection part of the second annular barrier.

In yet another embodiment, a plurality of annular barriers may be serially connected via flow lines.

Furthermore, the present invention relates to a well completion system comprising an annular barrier system according to the invention, a well tubular structure and a well head.

Said well head may comprise a well head valve.

Also, the well head valve may be connected to a pumping unit.

In one embodiment, a cutting device may be arranged in connection with the well head for cutting the flow line after expansion of the sleeves.

Moreover, the invention relates to a method for expanding an annular barrier according to the invention in an annulus between a well tubular structure and an inside wall of a casing or a borehole downhole, the method comprising the steps of:

- pressurising a fluid, and
- leading the fluid into the space of the annular barrier via the flow line so that the expandable sleeve is expanding.

Said method may further comprise the step of leading the fluid through the annular barrier into an expandable space of a second annular barrier for expanding the sleeve of the second annular barrier.

In one embodiment, the flow line may be cut off after the annular barrier(s) has/have been expanded.

Finally the invention relates to a method for arranging an annular barrier system according to the present invention in a well completion system, comprising the steps of:

- mounting an annular barrier as part of the well tubular structure,
- connecting a flow line to the opening of the annular barrier, and
- lowering the well tubular structure with the mounted annular barrier into a casing and/or a borehole while feeding the flow line.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
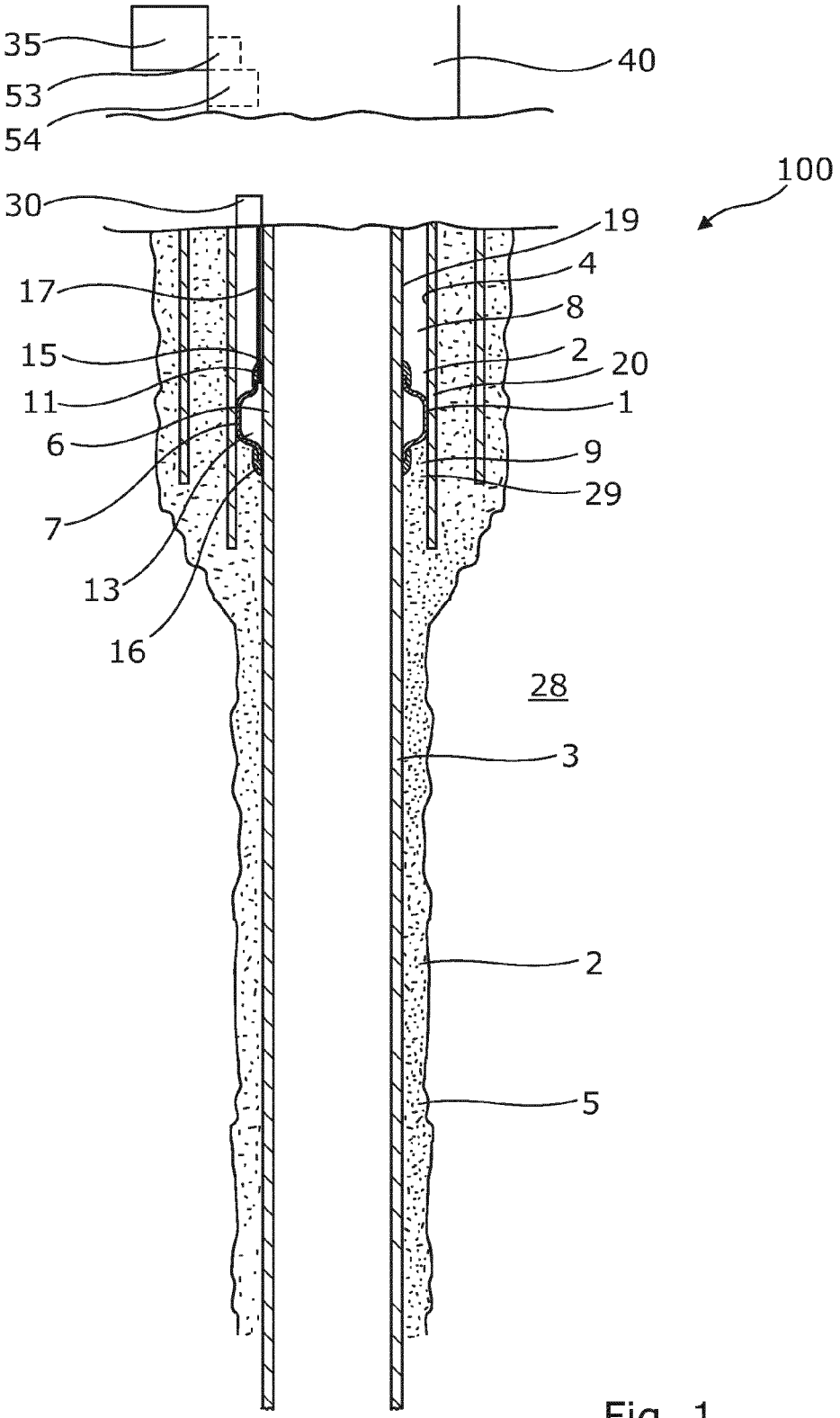
FIG. 1 shows an annular barrier system.

FIG. 1 shows an annular barrier system 100 in which the system is connected with a well tubular structure 3 which is again connected to a well head 40. The well tubular structure 3 is surrounded by an intermediate casing 20 forming an annulus 2 between the well tubular structure 3 and the intermediate casing 20. The annular barrier system 100 comprises an annular barrier 1 to be expanded in the annulus 2 between the well tubular structure 3 and an inside wall 4 of the intermediate casing 20 for providing zone isolation between a first zone 8 above the annular barrier 1 and a second zone 9 below the annular barrier 1. Hereby, the annulus 2 above the annular barrier 1 is isolated from the reservoir 28.

The annular barrier comprises a tubular part 6 extending in a longitudinal direction for mounting as part of the well tubular structure 3. The annular barrier further comprises an expandable sleeve 7 surrounding the tubular part 6 and surrounding a space 13 defined between the tubular part 6 and the expandable sleeve 7. The annular barrier further comprises an opening 11 for letting fluid into the space to expand the sleeve. The expandable sleeve is connected with the tubular part by means of a first connection part 15 and a second connection part 16, wherein the first connection part 15 is arranged nearest to the well head 40. In order to expand the sleeve, the system further comprises a flow line 17 fluidly connecting the well head 40 with the opening 11 for supplying fluid to the opening for expanding the expandable sleeve. In this way, the annular barrier 1 can be expanded from the rig via the well head by pressurising the flow line. In case of a subsea well head, the well head may comprise a pumping unit 35 which can be activated by means of a remote operated vehicle (ROV) (not shown) and thus, indirectly from the rig. In case of an on-shore well head, a pumping unit may be connected with one or more well heads for providing pressurised fluid down through the flow line 17.

By having the flow line 17 connecting the pumping unit 35 and the space 13, openings in the tubular part can be avoided and the well tubular structure does no longer have to be pressurised to a pressure large enough to expand the expandable sleeve 13. In this way, other components forming part of the well tubular part are not exposed to the high expansion pressure, and the components can therefore be selected irrespectively of whether they can withstand such high pressure. Furthermore, expansion of the annular barrier uses less energy as the whole well tubular structure does not have to be pressurised in order to expand the annular barrier but only have a substantially smaller volume being that of the flow line.

Figure 6A:
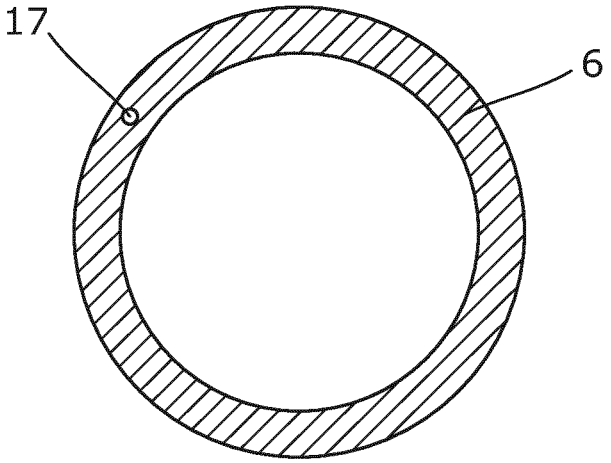
FIG. 6*a* shows a cross-sectional view of the tubular part.
Figure 6B:
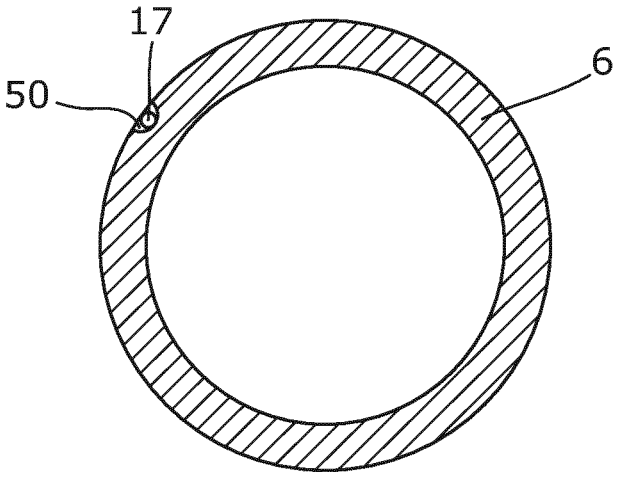
FIG. 6*b* shows a cross-sectional view of another embodiment of the tubular part.

As shown in FIG. 1, the flow line 17 extends along an outer face 19 of the well tubular structure 3. In another embodiment, the flow line extends inside the well tubular structure, as shown in FIG. 6A, or in a groove 50 in the well tubular structure, as shown in FIG. 6B.

Firstly, the annular barrier of the annular barrier system shown in FIG. 1 is mounted as part of the well tubular structure, and then the flow line is connected with the opening of the annular barrier before the well tubular structure with the mounted annular barrier is lowered into the intermediate casing and/or borehole while feeding the flow line so that the flow line stays connected with the opening.

Subsequently, the expandable sleeve of the annular barrier is expanded in the annulus 2 between the well tubular structure 3 and the inside wall 4 of a casing 20 or a borehole 5 downhole by activating the pumping unit 35 and pressurising a fluid and leading the fluid into the space of the annular barrier via the flow line, so that the expandable sleeve is expanding.

Figure 2:
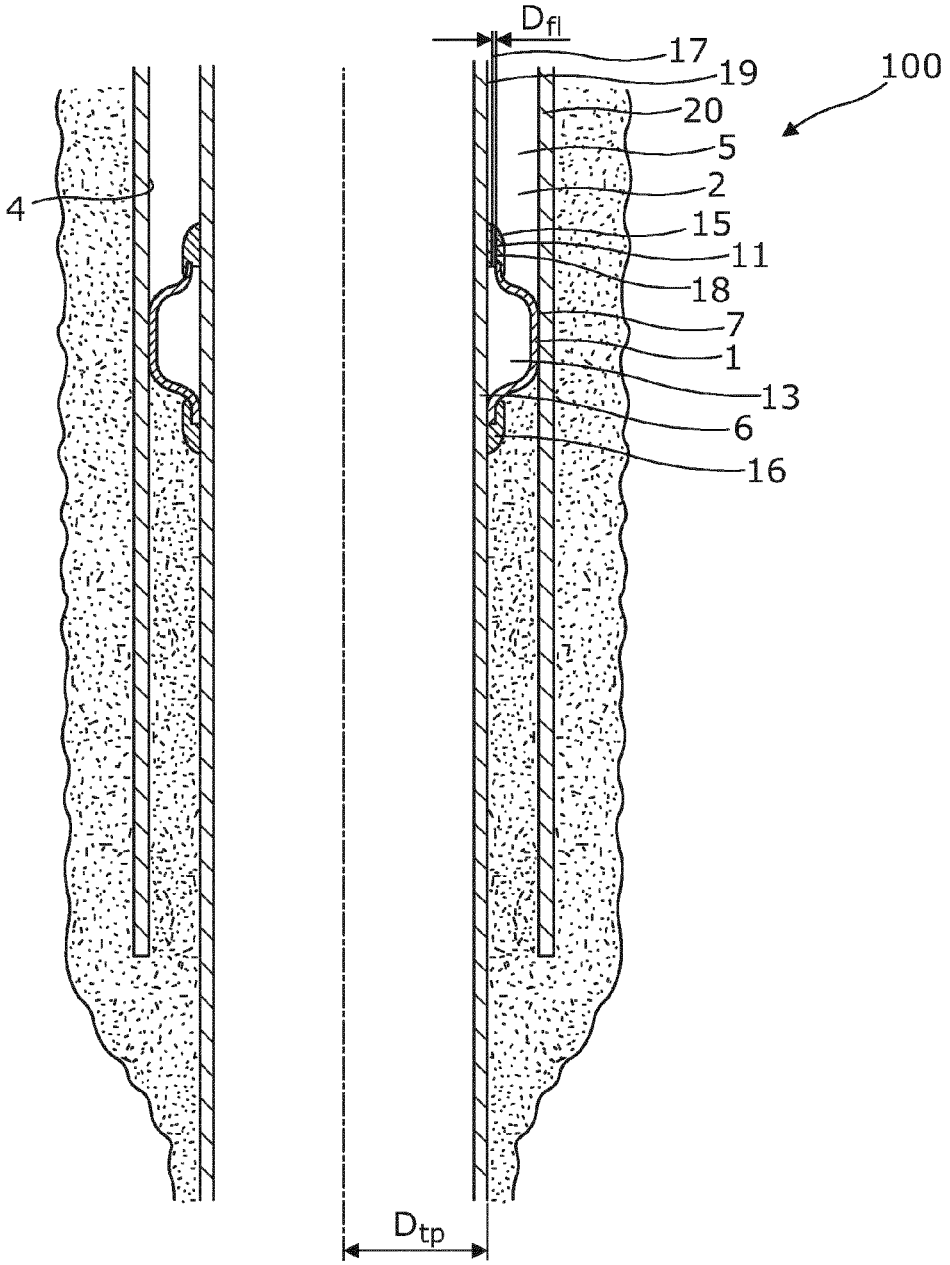
FIG. 2 shows the annular barrier system of FIG. 1 in an enlarged view.

As shown in FIG. 2, the opening 11 of the annular barrier is arranged in the first connection part 15. The flow line 17 is connected with the opening 11 for expanding the expandable sleeve 7 of the annular barrier so that an opening in the tubular part is avoided. Furthermore, having the opening in the connection part increases the sealing ability of the connection parts towards the tubular part. By avoiding the opening in the tubular part, the seal between the connection parts and the tubular part is of less importance to the well integrity. In another embodiment, the opening may be arranged in the tubular part so that the flow line extends within the well tubular structure. Hereby, the annular barrier system may fit existing systems on the market as only smaller adjustments need to be made.

In FIG. 2, the annular barrier comprises a valve 18 arranged in the opening 11 so as to let fluid in through the opening, but prevent said fluid from flowing into the flow line again. In other words, the valve may be a one-way valve. Furthermore, after the expandable sleeve has been expanded, the flow line is released from the well head and dumped into the annulus. Alternatively, the flow line 17 is released by a release device 30 shown in FIG. 1 in connection with the opening of the connection part 15 and is pulled up through the well head 40. The valve may be adapted to close at a predetermined pressure so that, when the expandable sleeve has been expanded, the valve closes at a pressure just above the expansion pressure securing that the expandable space 13 is closed when the flow is disconnected or cut by the release device 30. Thus, the release device 30 may be arranged in connection with the well head or in connection with the valve or the opening.

The flow line shown in FIG. 2 has an overall outer diameter $D_{fl}$, which is substantially smaller than an overall outer diameter $D_{tp}$ of the tubular part. The outer diameter $D_{fl}$, of the flow line is thus less than 50% of the outer diameter of the tubular part, preferably less than 30% of the outer diameter of the tubular part, more preferably less than 15% or less than the outer diameter of the tubular part. The flow line is thus easily placeable in the annulus between the well tubular structure and the intermediate casing.

Figure 3:
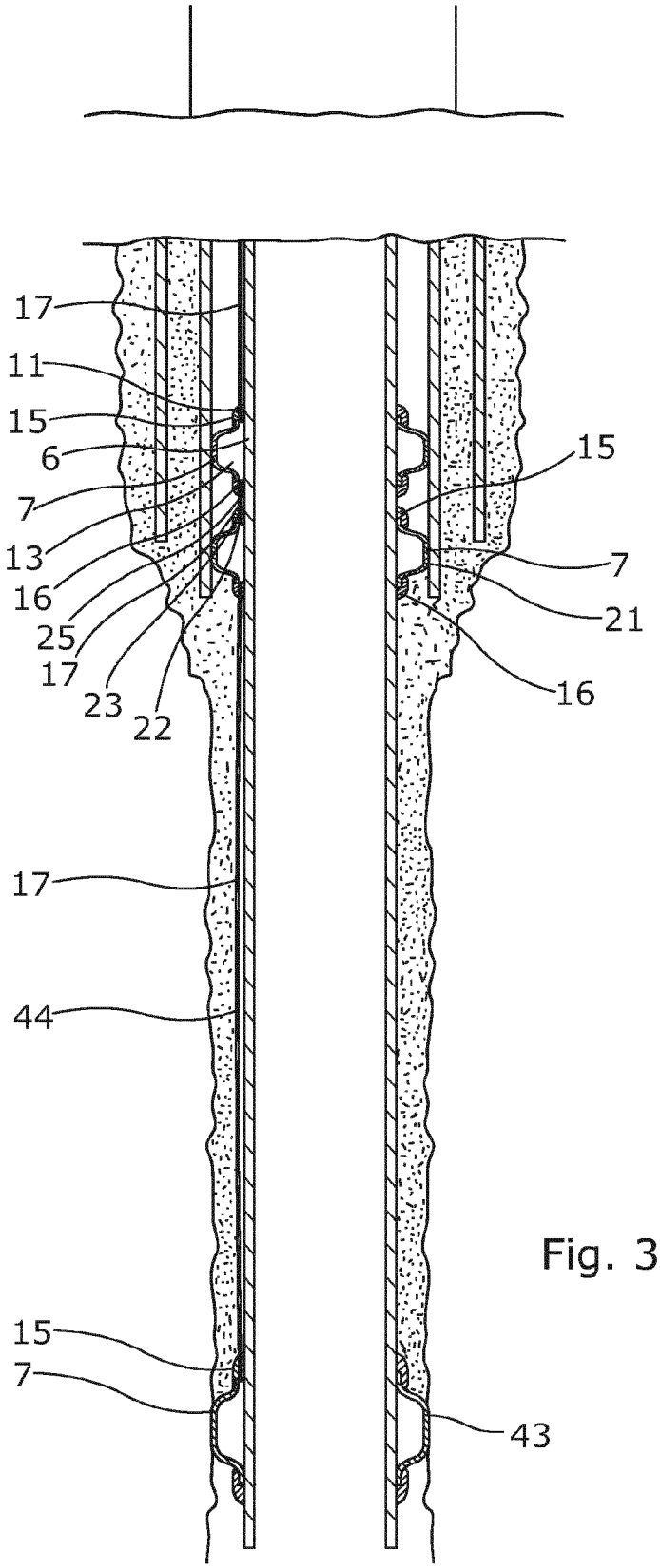
FIG. 3 shows another embodiment of the annular barrier system.

In FIG. 3, the annular barrier system further comprises a second annular barrier 21 comprising a tubular part 6 mounted as part of the well tubular structure 3, an expandable sleeve 7 surrounding the tubular part and defining a space 13, an opening 11 for letting fluid into the space to expand the sleeve, and a first connection part 15 and a second connection part 16 connecting the expandable sleeve with the tubular part, wherein the first connection part of the second annular barrier is arranged nearest to the well head.

The second connection part 16 of the first annular barrier 1 comprises the second opening 22 being in fluid connection with an opening 11 arranged in the first connection part 15 of the second annular barrier 21 via a second flow line part 25 for expanding the expandable sleeve of the second annular barrier. A second valve 23 is arranged in the second opening 22 which is adapted to close at a predetermined pressure.

As shown in FIG. 3, the annular barrier system may further comprise a third annular barrier 43 which is connected with the second connection part of the second annular barrier 21 via a flow line part 44 so that when the first annular barrier is expanded or set, the high pressurised fluid is led into the expandable space of the second annular barrier and further into the space of the third annular barrier. The expansion of several annular barriers may thus occur simultaneously or approximately simultaneously.

Figure 4:
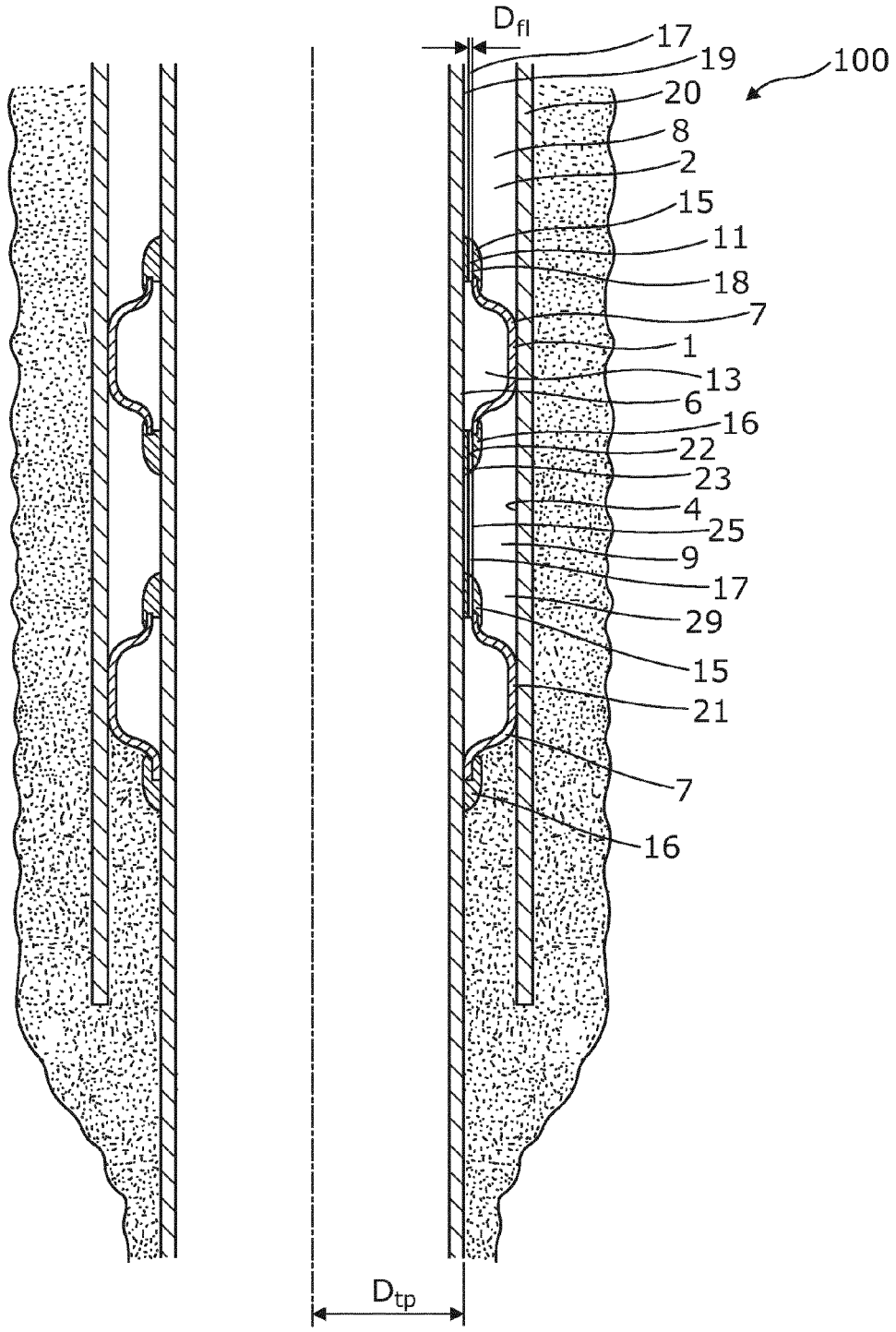
FIG. 4 shows the annular barrier system of FIG. 3 in an enlarged view.
Figure 5:
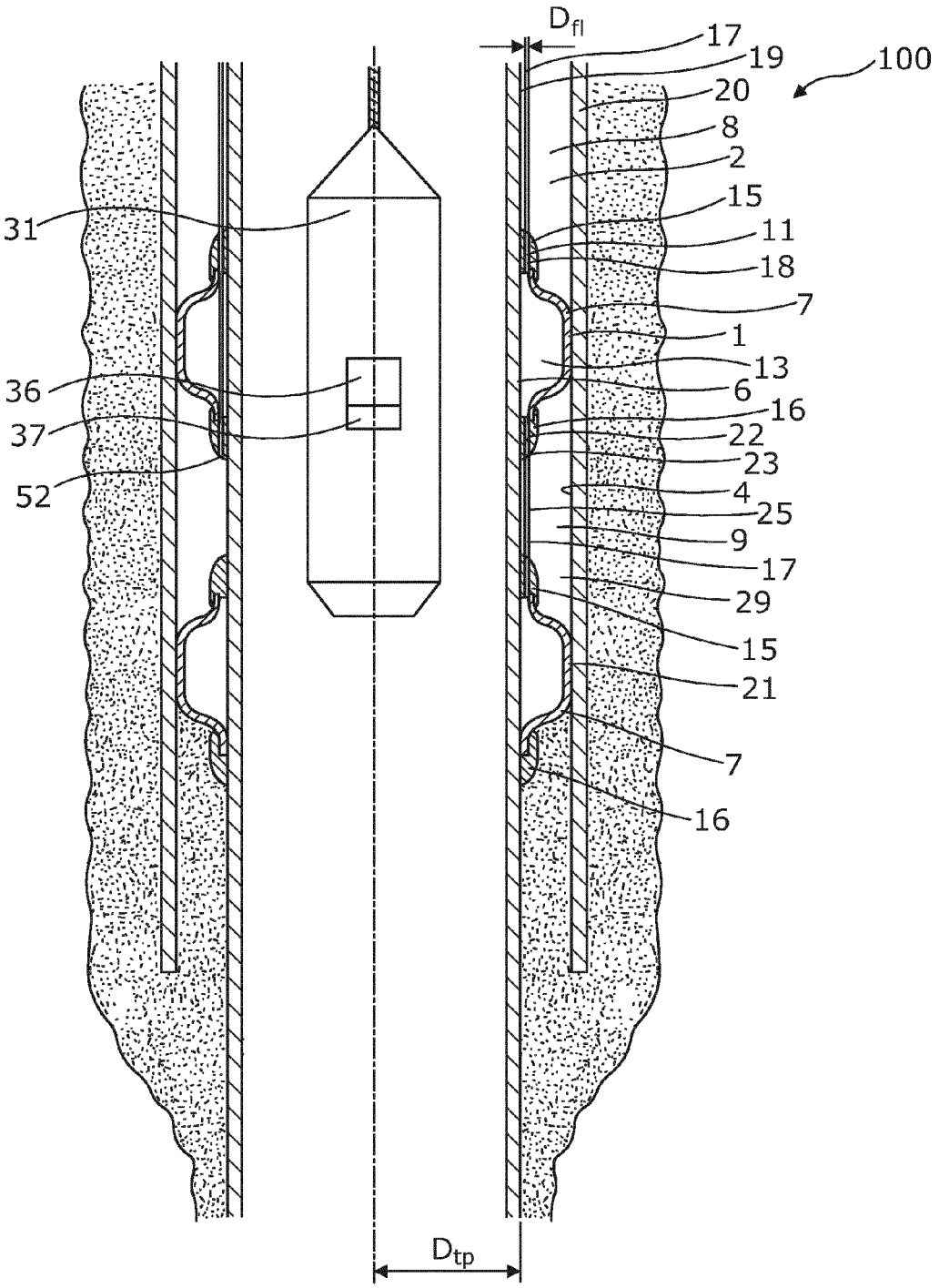
FIG. 5 shows another embodiment of the annular barrier system.

In FIG. 4, a first annular barrier 1 and a second annular barrier 21 are shown where the first annular barrier is connected with the top of the well or the well head by means of a flow line 17, and the first annular barrier is fluidly connected with the second annular barrier 21 by means of a second flow line part 25 of the flow line 17. A second valve 23 may be arranged in the second opening 22 in the second connection part of the first annular barrier. In FIG. 4, the second valve 23 is a two-way valve which, at a predetermined pressure, disconnects communication to the second annular barrier and opens fluid communication to an annular space 29 between the annular barriers in their expanded condition to pressurise the annular space. By being able to pressurise the annular space between the first and the second expanded annular barriers, the first annular barrier can be pressure-tested to determine whether the first annular barrier has sealed off the annulus providing a zone isolation between the first zone above the first annular barrier and a second zone below the first annular barrier. Some kind of recognisable chemicals may be added in the fluid flowing in the flow line or a pressure sensing tool 31 may be inserted in the well tubular structure as shown in FIG. 5. The pressure testing tool comprises a gas detection unit 36 and/or a pressure measuring unit 37.

In another embodiment, the annular barrier system comprises a third flow line 52 for letting fluid into an annular space between the annular barriers in their expanded condition to pressurise the annular space. The third flow line may extend from the pumping unit to the first annular barrier and is connected with a channel in the first barrier, through the first barrier to the second opening in the second connection part. In another embodiment, the channel may extend through the tubular part of the first barrier in order to let fluid into the annular space. In another embodiment, the system comprises a switch valve fluidly connecting the first flow line with the second flow line when the fluid reaches a predetermined pressure. In this way, only the first flow line is connected with the pumping unit and the second flow line is connected with the first flow line further down the annulus. In one embodiment, the switch valve is a hydrostatic switch.

The invention relates to a well completion system comprising the annular barrier system described above, the well tubular structure and the well head as shown in FIG. 1. The well head may comprise a well head valve 53 connected to a pumping unit. The well completion system may comprise a cutting device 54 arranged in connection with the well head for cutting the flow line after expansion of the sleeves.

The present invention is susceptible to embodiments of different forms. Specific embodiments are described in detail and are shown in the drawings with the understanding that the present disclosure is to be considered as an exemplification of the principles of the invention and is not intended to limit the invention to that illustrated and described herein. It is to be fully recognised that the different teachings of the different embodiments discussed above may be employed separately or in any suitable combination to produce desired results.

By a flow line is meant a tubular pipe extending from the top of the well down along and on the outside of the casing in the annulus between the intermediate casing surrounding the casing and the intermediate casing. The flow line is supplying pressurised fluid, such as sea water, down to the expandable space of the annular barrier in order to expand the sleeve. The flow line is therefore made in a material, such as metal, capable of withstanding such high pressure, i.e. a pressure difference of up to 10,000 PSI.

An annular barrier may also be a packer or similar expandable means. The well tubular structure can be the production tubing or casing or a similar kind of tubing downhole in a well or a borehole. As mentioned above, the annular barrier can be used both in between the inner production tubing and an outer tubing in the borehole, or between a tubing and the inner wall of the borehole. A well may have several kinds of tubing and the annular barrier of the present invention can be mounted for use in all of them.

The valves that may be utilised to control the flow through the first and second fluid passages may be any kind of valve capable of controlling flow, such as a ball valve, butterfly valve, choke valve, check valve or non-return valve, diaphragm valve, expansion valve, gate valve, globe valve, knife valve, needle valve, piston valve, pinch valve, or plug valve.

The expandable tubular metal sleeve may be a cold-drawn or a hot-drawn tubular structure.

The fluid used for expanding the expandable sleeve may be any kind of well fluid present in the borehole surrounding the tool and/or the well tubular structure. Also, the fluid may be cement, gas, water, polymers, or a two-component compound, such as powder or particles mixing or reacting with a binding or hardening agent. Part of the fluid, such as the hardening agent, may be present in the cavity between the tubular part and the expandable sleeve before injecting a subsequent fluid into the cavity.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string, etc., used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier system connected with a well head via a well tubular structure, comprising:

a first annular barrier and a second annular barrier to be expanded in an annulus between the well tubular structure and an inside wall of a casing or a borehole downhole for providing zone isolation between a first zone and a second zone, each annular barrier comprising:

a tubular part extending in a longitudinal direction for mounting as part of the well tubular structure;

an expandable sleeve surrounding the tubular part and defining a space;

an opening for letting fluid into the space to expand the sleeve; and a first connection part and a second connection part connecting the expandable sleeve with the tubular part, and wherein the first connection part is arranged nearest to the well head, the system further comprising a first flow line fluidly connecting the well head with the opening of the first annular barrier for supplying fluid to the opening for expanding the expandable sleeve, and the second connection part of the first annular barrier having a second opening and the second opening of the second connection part being fluidly connected with an opening arranged in the first connection part of the second annular barrier via a second flow line for expanding the expandable sleeve of the second annular barrier, the space of the expandable sleeve of the first annular barrier and the space of the expandable sleeve of the second annular barrier being directly fluidly connected via the second flow line, the second flow line being configured to allow fluid to pass directly from the space of the first annular barrier to the space of the second annular barrier, wherein a two-way valve is arranged in the second opening, the two-way valve being configured, at a predetermined pressure, to disconnect communication to the second annular barrier and to open fluid communication to an annular space between the annular barriers in their expanded condition to pressurise the annular space.

2. An annular barrier system according to claim 1, wherein a valve is arranged in the opening of the first connection part of the first annular barrier.

3. An annular barrier system according to claim 2, wherein the valve is adapted to close at a predetermined pressure.

4. An annular barrier system according to claim 1, wherein the first flow line extends along an outer face of the well tubular structure.

5. An annular barrier system according to claim 1, wherein the first flow line may extend inside or in a groove in the well tubular structure.

6. An annular barrier system according to claim 1, wherein the first flow line has an overall outer diameter ($D_{fl}$) which is substantially smaller than an overall outer diameter ($D_{tp}$) of the tubular part.

7. An annular barrier system according to claim 1, wherein the first connection part has the opening fluidly connected to the well head via the first flow line.

8. An annular barrier system according to claim 1, wherein the system comprises a release device arranged in connection with the opening of the first annular barrier for disconnecting the first flow line after expansion of the sleeve.

9. An annular barrier system according to claim 1, wherein the system comprises a pressure sensor tool.

10. An annular barrier system according to claim 9, wherein the tool comprises a gas detection unit and/or a pressure measuring unit.

11. An annular barrier system according to claim 1, wherein the system comprises a third annular barrier comprising:

a tubular part extending in a longitudinal direction for mounting as part of the well tubular structure;

an expandable sleeve surrounding the tubular part and defining a space;

an opening for letting fluid into the space to expand the sleeve; and a first connection part and a second connection part connecting the expandable sleeve with the tubular part, and wherein the first connection part is arranged nearest to the well head, the system further comprising a flow line fluidly connecting an opening in the second connection part of the second annular barrier with an opening in the first connection part of the third annular barrier for supplying fluid to the opening for expanding the expandable sleeve of the third annular barrier.

12. An annular barrier system according to claim 1, wherein the two-way valve is a switch valve fluidly connecting the first flow line with the second flow line when the fluid reaches a predetermined pressure.

13. An annular barrier system according to claim 1, wherein the second flow line is connected with a fluid channel in the first annular barrier, and the channel extends through the first annular barrier in order to let fluid into the annular space.

14. An annular barrier system according to claim 12, wherein the switch valve is a hydrostatic switch.

15. A well completion system comprising an annular barrier system according to claim 1, a well tubular structure and a well head.

16. A well completion system according to claim 15, wherein a well head valve is connected to a pumping unit.

17. A well completion system according to claim 15, wherein a cutting device is arranged in connection with the well head for cutting the flow line after expansion of the sleeves.

18. A method for expanding an annular barrier of the annular barrier system according to claim 1, in an annulus between a well tubular structure and an inside wall of a casing or a borehole downhole, the method comprising the steps of:

pressurising a fluid, and leading the fluid into the space of the annular barrier via the first flow line so that the expandable sleeve expands.

19. A method for arranging an annular barrier system according to claim 1 in a well completion system, comprising the steps of:

mounting an annular barrier as part of the well tubular structure, connecting the first flow line to the opening of the annular barrier, and lowering the well tubular structure with the mounted annular barrier into a casing and/or a borehole while feeding the first flow line.

* * * * *